US005734221A

United States Patent [19]

van Os

[11] Patent Number: 5,734,221

[45] Date of Patent: Mar. 31, 1998

[54] VESSEL SHAPES AND COIL FORMS FOR ELECTRODELESS DISCHARGE LAMPS

[75] Inventor: Ron van Os, Sunnyvale, Calif.

[73] Assignee: Diablo Research Corporation, Sunnyvale, Calif.

[21] Appl. No.: 139,387

[22] Filed: Oct. 19, 1993

[51] Int. Cl.[6] ..... H01J 5/16; H01J 1/62; H05B 41/16

[52] U.S. Cl. ..... 313/113; 313/494; 313/635; 313/634; 313/493; 315/248

[58] Field of Search ..... 313/494, 496, 313/503, 493, 234, 630, 634, 635, 483, 484, 485, 607, 608; 362/84, 328, 329, 335, 317; 315/248

[56] References Cited

U.S. PATENT DOCUMENTS

| | | | |
|---|---|---|---|
| 4,005,330 | 1/1977 | Glascock, Jr. | 315/248 |
| 4,119,889 | 10/1978 | Hollister | 315/248 |
| 4,245,179 | 1/1981 | Buhrer | 315/248 |
| 4,266,167 | 5/1981 | Proud et al. | 315/248 |
| 4,675,577 | 6/1987 | Hanlet | 315/248 |
| 4,872,741 | 10/1989 | Dakin et al. | 350/345 |
| 4,950,059 | 8/1990 | Roberts | 350/345 |
| 5,013,975 | 5/1991 | Ukegawa et al. | 315/248 |
| 5,500,574 | 3/1996 | Popov et al. | 313/573 |

FOREIGN PATENT DOCUMENTS

| | | | |
|---|---|---|---|
| 2601664 | 7/1976 | Germany | 315/248 |
| 404357661 | 12/1992 | Japan | 313/234 |
| 094022280A1 | 9/1994 | WIPO | 315/248 |

OTHER PUBLICATIONS

D. Hollister et al., "A Xenon Lamp With Two Less Electrodes", Electro–Optical Systems Design, Feb. 1971, 6 pgs.

*Primary Examiner*—Thomas D. Lee
*Assistant Examiner*—Jerome Grant, II
*Attorney, Agent, or Firm*—Skjerven, Morrill, MacPherson, Franklin & Friel; David E. Steuber

[57] ABSTRACT

A discharge vessel for an electrodeless lamp having a pair of substantially parallel front and back walls. In one implementation, the front wall of the discharge vessel has a collimating structure, e.g a fresnel lens, for directing the light in a preferential direction such as in a flood light. In another implementation, the flat discharge vessel is quadrilateral and together with one or more quadrilateral excitation coils can be used as a backlight for a flat panel display. In yet another implementation, a cup-shaped discharge vessel with a collimating structure on the front wall is used in an electrodeless lamp for a task lighting such as a spot light.

36 Claims, 8 Drawing Sheets

VESSEL SHAPES AND COIL FORMS FOR ELECTRODELESS DISCHARGE LAMPS

CROSS-REFERENCE TO RELATED APPLICATIONS

This application is related to, and incorporates by reference, the following U.S. patent applications: the application entitled "Radio Frequency Interference Reduction Arrangements for Electrodeless Discharge Lamps" filed May 20, 1992, Ser. No. 07/883,850, now U.S. Pat. No. 5,397,966; the application entitled "Discharge Lamps and Methods for Making Discharge Lamps", filed May 20, 1992, Ser. No. 07/883,971; the application entitled "Zero-Voltage Complementary Switching High Efficiency Class D Amplifier" filed May 20, 1992, Ser. No. 07/887,168, now U.S. Pat. No. 5,306,986; the application entitled "Electrodeless Discharge Lamp with Spiral Induction Coil" filed Mar. 24, 1993, Ser. No. 08/036,303, now U.S. Pat. No. 5,349,271; and the application entitled "Dimmer for Electrodeless Discharge Lamp" filed Oct. 14, 1992, Ser. No. 07/961,763.

FIELD OF THE INVENTION

This invention relates to vessel shapes and coil forms for electrodeless discharge lamps. More particularly, this invention relates to a self focusing and flatter vessel shape for an electrodeless discharge lamp.

BACKGROUND OF THE INVENTION

Electrodeless discharge lamps are described in sources such as U.S. Pat. No. 4,010,400 to Hollister, incorporated herein by reference, which describes an electrodeless discharge lamp including an induction coil positioned in a central cavity surrounded by a sealed discharge vessel. The discharge vessel contains a mixture of a metal vapor and an ionizable gas. Mercury vapor and argon are frequently used. The induction coil is connected in series with a capacitor. A radio frequency (RF) signal is generated by an oscillator, amplified and fed into a series L-C network. When the L-C network is energized by this RF signal, it resonates and the induction coil generates electromagnetic energy which is transferred to the gaseous mixture in the sealed discharge vessel.

Electrodeless discharge lamps operate in two stages. In the start-up electromagnetic discharge mode, i.e., as the lamp is being turned on, the electric field from the induction coil causes some of the atoms in the gaseous mixture to be ionized. The electrons which are freed in this process circulate around the induction coil within the sealed discharge vessel. Collisions between these electrons and the atoms release additional electrons until a plasma of circulating charged particles is formed. The induction coil and plasma behave in the manner similar to a transformer, i.e. with the coil acting as the primary winding and the discharge current acting as the secondary winding. However, because of air gaps between the coil and the sealed discharge vessel, typically made of glass, the magnetic coupling between the coil and the gaseous mixture is normally quite poor.

Many of these collisions excite the mercury atoms to a higher energy state rather than ionizing them. As the mercury atoms fall back from the higher energy state, they emit radiation, primarily in the ultraviolet (UV) spectrum. This radiation impinges on phosphors which coat the inner surface of the discharge vessel. The phosphors are selected to be highly excitable by UV radiation and in turn emit visible light as they return from their excited state.

During the second stage of operation, i.e. after the electron flow in the gaseous mixture has been established, the magnetic field generated by the induction coil becomes of primary importance in maintaining the discharge.

The early introduction of the incandescent lamp caused a major revolution in the way light was delivered. Originally, the pear-shaped glass vessel was chosen as the enclosure of choice because it was strong, inexpensive, and was the easiest shape for a glass blower to achieve. The vessels were then produced manually by blowing air into a bit of molten glass at the end of a long pipe. Although glass vessels are mass produced today using modern machinery, the pear-shaped vessel has been retained since the configuration also lends itself to high speed machines. As a result, the pear shape has become the industry standard.

The incandescent lamp in a pear-shaped vessel has several drawbacks. Being a point source of light, it causes an unpleasant glare which requires the addition of shades, reflectors, and/or baffles to make the lighting system more acceptable to the user. Unfortunately, these techniques also reduce the energy efficiency of the light source. Various glass shapes have been used to deliver an improved quantity of usable light for particular applications. This includes the pressed glass reflector (known as a PAR lamp) which delivers light in a preferential direction, making it more efficient for task and display lighting applications.

Electrodeless discharge lamps have generally retained the original pear-shape because these newer light sources were intended to serve as energy efficient replacements for the standard incandescent lamp. Since the existing sockets had been designed around the standard industry bulb shape, it was important to retain compatibility with the existing physical shape.

Task lighting or directional applications present a challenge for electrodeless discharge lamps. Electrodeless discharge lamps have the characteristics of providing a uniform level of illumination over the surface area of the phosphor layer, i.e. they are not point sources of light. Therefore, reflectors are not particularly efficient in increasing the light level in any preferential direction.

Accordingly, there is a need for electrodeless discharge lamps which deliver useful quantities of light in a preferential manner to efficiently illuminate a task or specific area.

SUMMARY OF THE INVENTION

In accordance with the invention, a substantially flat vessel serves as a containment vessel for an ionizable gaseous mixture which includes a metal vapor and a rare gas. The front and back walls of the vessel are similar in shape and are generally parallel to each other. The gaseous mixture within the vessel is excited by an induction coil, which is disposed adjacent to one of the walls. The induction coil has a shape which approximates the shape of one wall of the vessel and is coupled to a high frequency source of RF energy.

In one embodiment, the discharge vessel is oval or round and is coupled with a substantially planar spiral coil. Such a lamp is well suited for use as a flood light.

In another embodiment the discharge vessel is rectangular and is coupled with a substantially planar, quadrilateral spiral coil. Such a rectangular and planar light source is well suited as a backlight for a flat panel display device.

In yet another embodiment, the discharge vessel comprises two parallel cup-shaped surfaces, either or both of which may be the light emissive surface. The lamp is driven by a conical spiral induction coil which may be disposed adjacent to either surface.

The discharge vessel may also be fitted with a fresnel lens or equivalent to enhance the quality of the light output in a preferential direction, and/or to diffuse the light, thereby increasing its uniformity.

DETAILED DESCRIPTION OF THE INVENTION

Figure 1A:
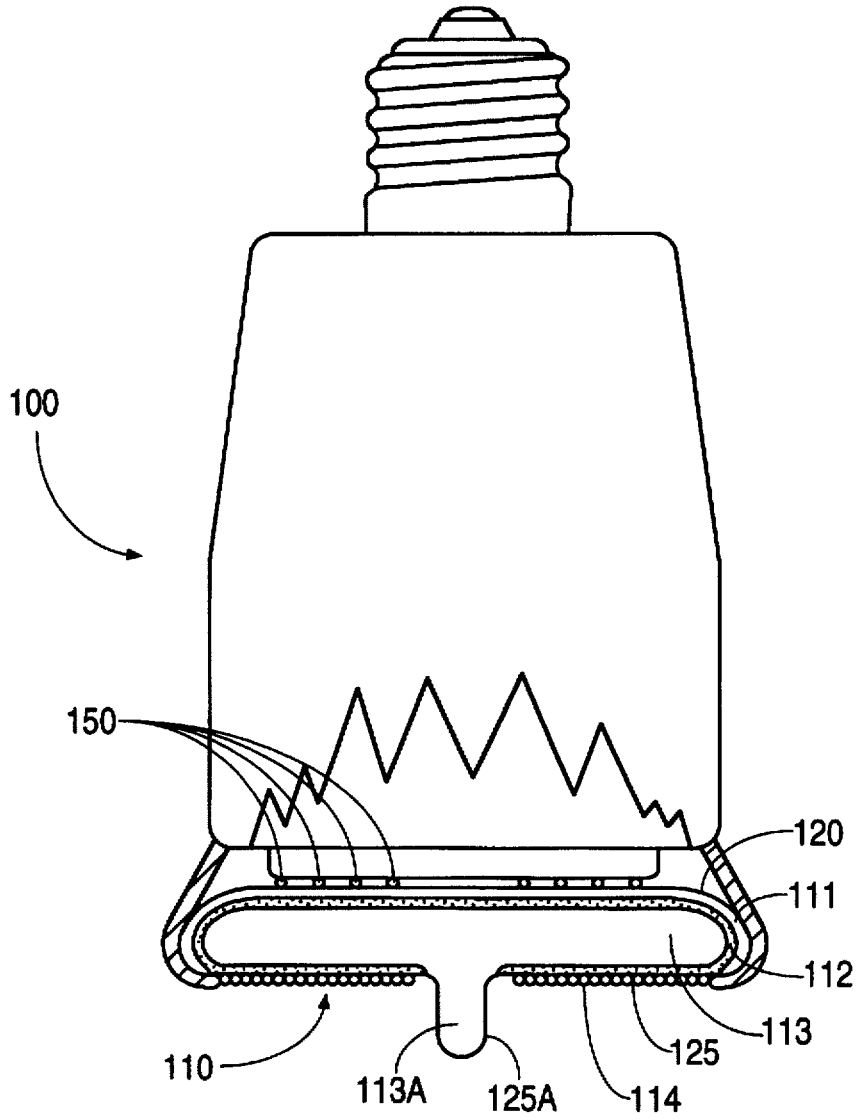
FIG. 1A shows a partial cutaway view of a first embodiment of an electrodeless discharge lamp with a substantially flat cylindrical discharge vessel.

FIG. 1A shows a partial cutaway view of a first embodiment of an electrodeless discharge lamp 100 with a substantially flat cylindrical discharge vessel 110. Discharge vessel 110 includes a pair of walls, a front wall 125 and a back wall 120, which are generally parallel to each other. Front wall 125 and back wall 120 of vessel 110 can be substantially flat, slightly concave or slightly convex. A slightly concave or convex wall profile adds to the mechanical strength of the low pressure discharge vessel 110 which is subjected to external atmospheric pressure. Other shapes for discharge vessel 110 are possible, including a substantially flat oval shape.

Vessel 110 contains an ionizable gaseous mixture 113, which includes a metal vapor, such as mercury, and a rare gas, such as argon. Front wall 125 has a protrusion 125*a* for condensing mercury vapor 113 thereby forming a "cold-spot" 113*a*. A substantially flat spiral coil 150 is disposed adjacent the outside surface of back wall 120. A reflective layer 111, such as titanium oxide, is formed on the inner surface of back wall 120. A phosphor layer 112 is disposed on top of reflective layer 111 and also extends over the inner surface of front wall 125. Reflective layer 111 is designed to reflect both ultra violet light generated by the discharge and visible light generated by phosphor layer 112.

An induction coil 150 serves as the excitation energy source for gaseous mixture 113. UV radiation is produced as the atoms of metal in gaseous mixture 113 cycle between their excited and non-excited states. The UV radiation in turn causes phosphor layer 112 to produce visible light. Reflective layer 111 serves to reflect and hence intensify the resulting visible radiation.

A collimating structure 114 is disposed on front wall 125 of vessel 110. This collimating structure 114 causes light emitted by phosphor layer 112 and light reflected off reflective layer 111 to be directed in a preferential direction. In other words, such an electrodeless discharge lamp serves as a flood light. Collimating structure 114 can be produced integrally in front wall 125 using well known manufacturing methods such as stamping.

Figure 1B:
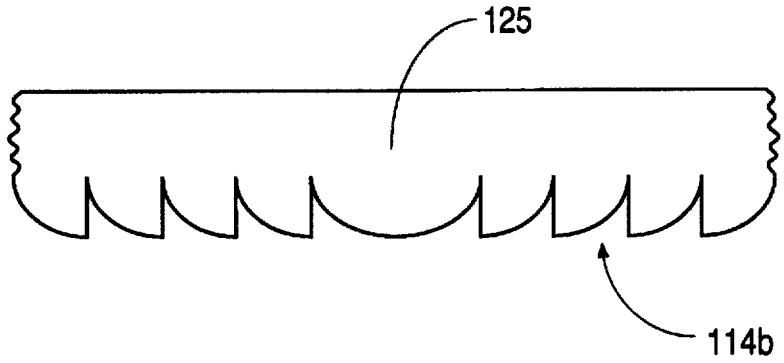
FIGS. 1B and 1C are detailed cross-sectional views of two collimating structures for the discharge lamp of FIG. 1A, showing a fresnel lens and a "ridged" front with a series of concentric ridges, respectively.
Figure 1C:
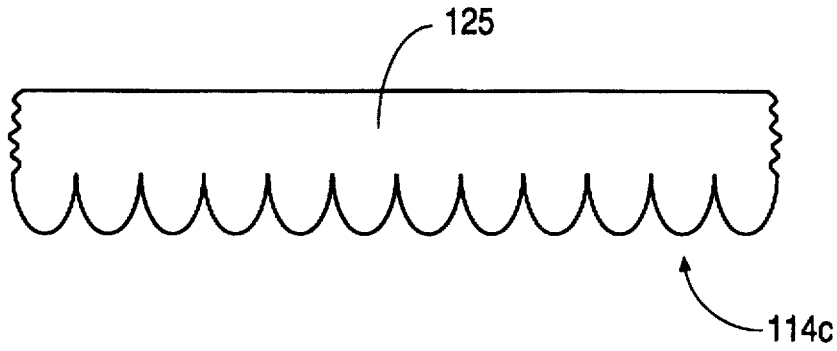

Collimating structure 114 can be any one of well known structures, e.g., a fresnel lens 114*b* or a "ridged" front 114*c* comprising a series of concentric rounded ridges, whose cross-sectional views are shown in FIGS. 1B and 1C, respectively. Collimating structure 114 can also help to diffuse light emitted by discharge lamp 100, thereby producing a more uniform beam of light.

Figure 2:
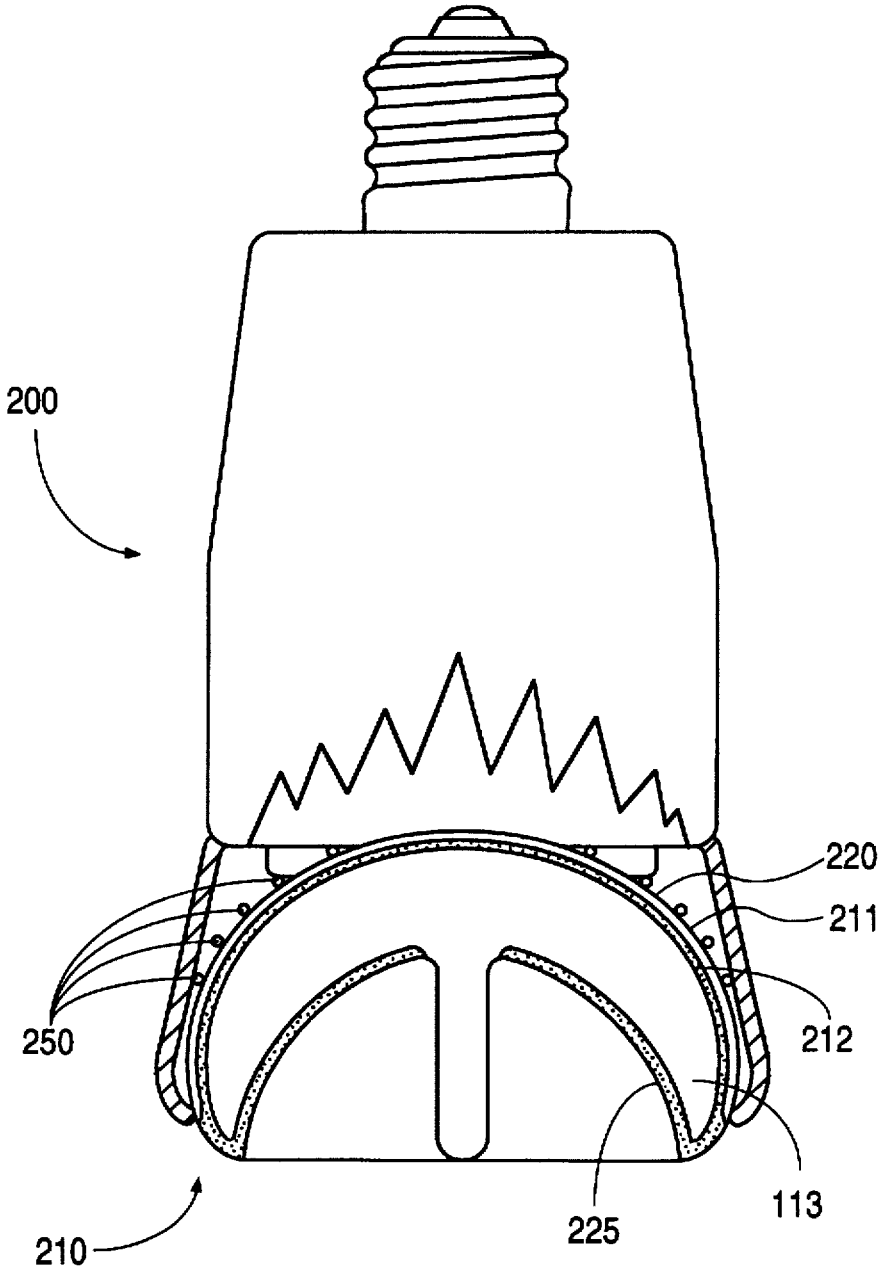
FIG. 2 shows a partial cutaway view of a second embodiment of an electrodeless lamp with a curved cylindrical discharge vessel having a concave cup-shaped profile and a pair of substantially parallel front and back walls.

FIG. 2 shows a cutaway view of a second embodiment of an electrodeless discharge lamp 200 with a concave discharge vessel 210. Vessel 210 has a cross section view which is somewhat banana-shaped, and has an overall profile of a shallow cup or a deep saucer, with a substantially parallel front wall 225 and back wall 220. Vessel 210 is evacuated and contains an ionizable gaseous mixture 113. A spiral coil 250 disposed adjacent to the outside surface of back wall 220 provides the excitation energy for gaseous mixture 113. Coil 250 is generally conical and follows the shape of back wall 220. A reflective layer 211 is formed on the inner surface of back wall 220. A phosphor layer 212 is deposited over reflective layer 211 and the inner surface of front wall 225. UV radiation is produced by excited gaseous mixture 113 and converted into visible light by phosphor layer 212 in the manner described in the first embodiment.

The cup-shaped or saucer-shaped discharge vessel 210 causes the emitted light to be directed in a more focused manner, i.e., for use as a spot light illuminating a specific area. A collimating structure similar to that of the first embodiment 100 can be incorporated on the outside surface of front wall 225 to further control the direction and/or diffuse the emitted light.

Figure 3A:
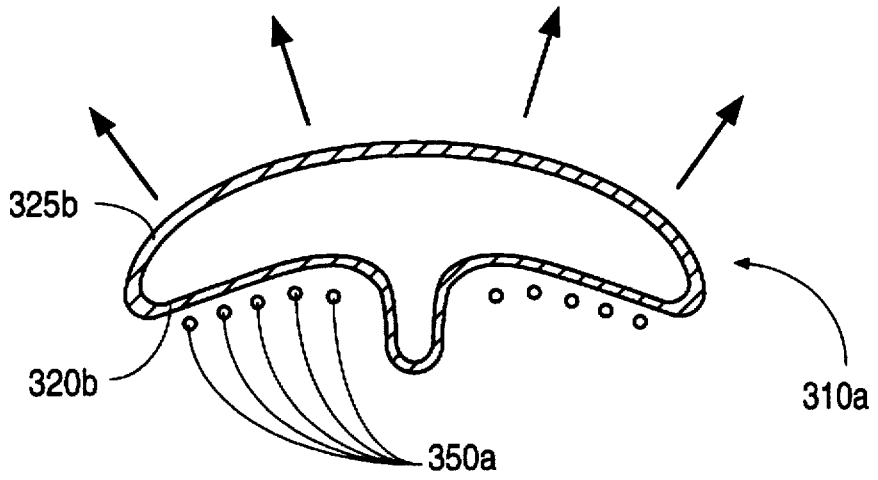
FIGS. 3A and 3B are cross-sectional views of two additional embodiments of convex cup-shaped discharge vessels with varying degrees of curvature.
Figure 3B:
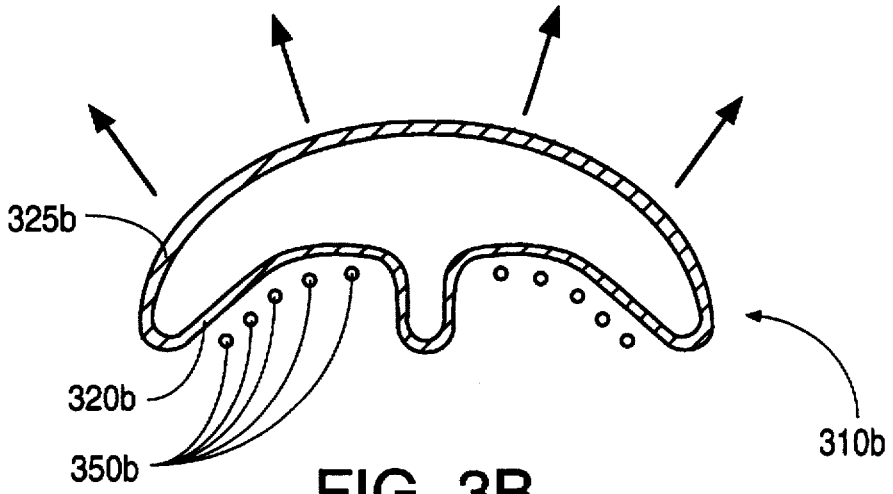

FIGS. 3A and 3B show embodiments of two additional discharge vessels 310*a* and 310*b*. Both vessels 310*a* and 310*b* are cup-shaped or saucer-shaped, as in the second embodiment, with varying degrees of curvature. The main difference is that vessels 310*a*, 310*b* have spiral coils 350*a*, 350*b* disposed on the concave side of back walls 320*a*, 320*b*, with light emitting from the convex side of front walls 325*a*, 325*b*, respectively.

Lamps according to the invention are particularly suitable for use as backlights for displays such as liquid crystal displays. In another embodiment as illustrated by cross-sectional and exploded views, FIGS. 4A and 4B, respectively, an electrodeless discharge lamp 400 includes a flat rectangular shaped discharge vessel 410 disposed adjacent to a spiral coil 450. Spiral coil 450 has a quadrilateral shape and is supported by a coil substrate 451, as illustrated in the plan view of FIG. 4C. Discharge vessel 410 has a flat front wall 425 and a parallel flat back wall 420. A reflective layer 411, comprising barium sulfate or titanium oxide, is formed on the upper surface of back wall 420 and extends over the sidewalls of vessel 410. A phosphor layer 112, preferably made of a tristimulus phosphor, coats the inside of vessel 410, with planar sections 412*a* and 412*b* being formed over reflective layer 411 and below the lower surface of front wall 425, respectively. Front wall 425 and back wall 420 are joined together along their respective edges to seal vessel 410 for containing a gaseous mixture 413. Mixture 413 comprises a metal vapor, such as mercury, and a rare gas, such as argon. Adherence of phosphor layers 412*a* and 412*b* to front and back walls 425 and 420, respectively, is enhanced by the use of adhesion layers 408*a* and 408*b* as shown in FIG. 4B. Suitable materials for adhesion layers 408*a* and 408*b* include aluminum oxide and silicon oxide.

The rectangular electrodeless discharge lamp 400 serves as a back light for a flat panel liquid crystal display assembly 460, having an active or passive matrix liquid crystal display (PMLCD or AMLCD) capable of displaying a full color image. Visible light emitted by lamp 400 is directed towards liquid crystal display (LCD) assembly 460. The ability to produce high luminance at low power and the absence of electrodes makes electrodeless discharge lamp 400 a superior option for backlighting LCD assembly 460.

FIG. 4B illustrates in greater detail the exploded view of the structure of electrodeless discharge lamp 400 and LCD assembly 460. Lamp 400 uses the same technology used in lamps 100 and 200, discussed above, the major difference being the completely flat, rectangular shape of discharge vessel 410. An optional collimating diffusion layer 414 is disposed on the upper surface of front wall 425 of lamp 400 and below LCD assembly 460. Diffusion layer 414 comprises rows of parallel ridges. Other well-known collimating structures can also be used, such as a fresnel lens.

LCD assembly 460 comprises the following layers. Starting from the bottom of LCD assembly 460, a first polarizer 480*a* is formed on the lower surface of a lower glass wall 470*a*. Lower glass wall 470*a* and an upper glass wall 470*b* sandwich a matrix of X-Y electrodes 490*b*, liquid crystal molecules 495, a common electrode layer 490*a*, and a RGB color filter 485 disposed on the lower surface of upper glass wall 470*b*. Completing LCD assembly are a second polarizer 480*b* and an anti-reflective coating layer 475, both of which are disposed on the top surface of upper glass wall 470*b*.

Other shapes for LCD assembly 460 and backlight lamp 400 are possible, including a flat square shape or a flat rounded shape.

Figure 4A:
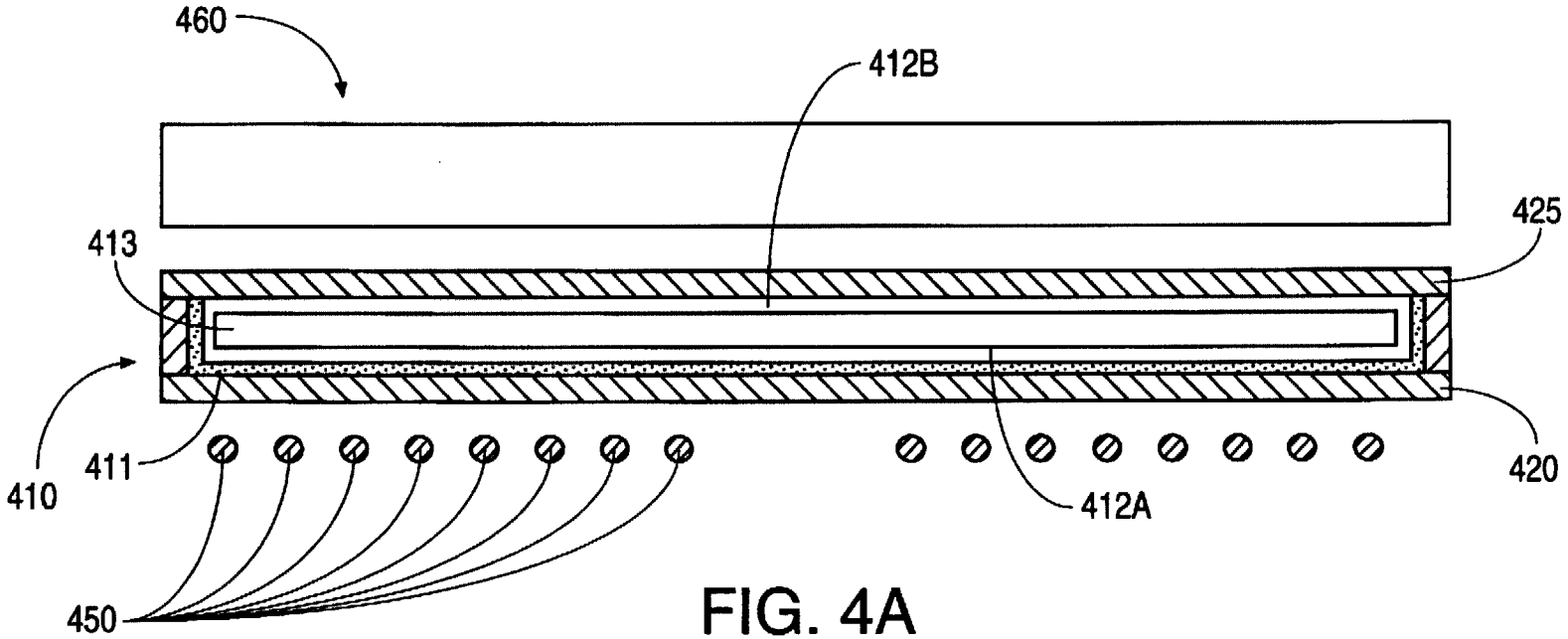
FIG. 4A is a cross-sectional view of a flat panel display including a quadrilateral discharge vessel according to this invention.
Figure 4B:
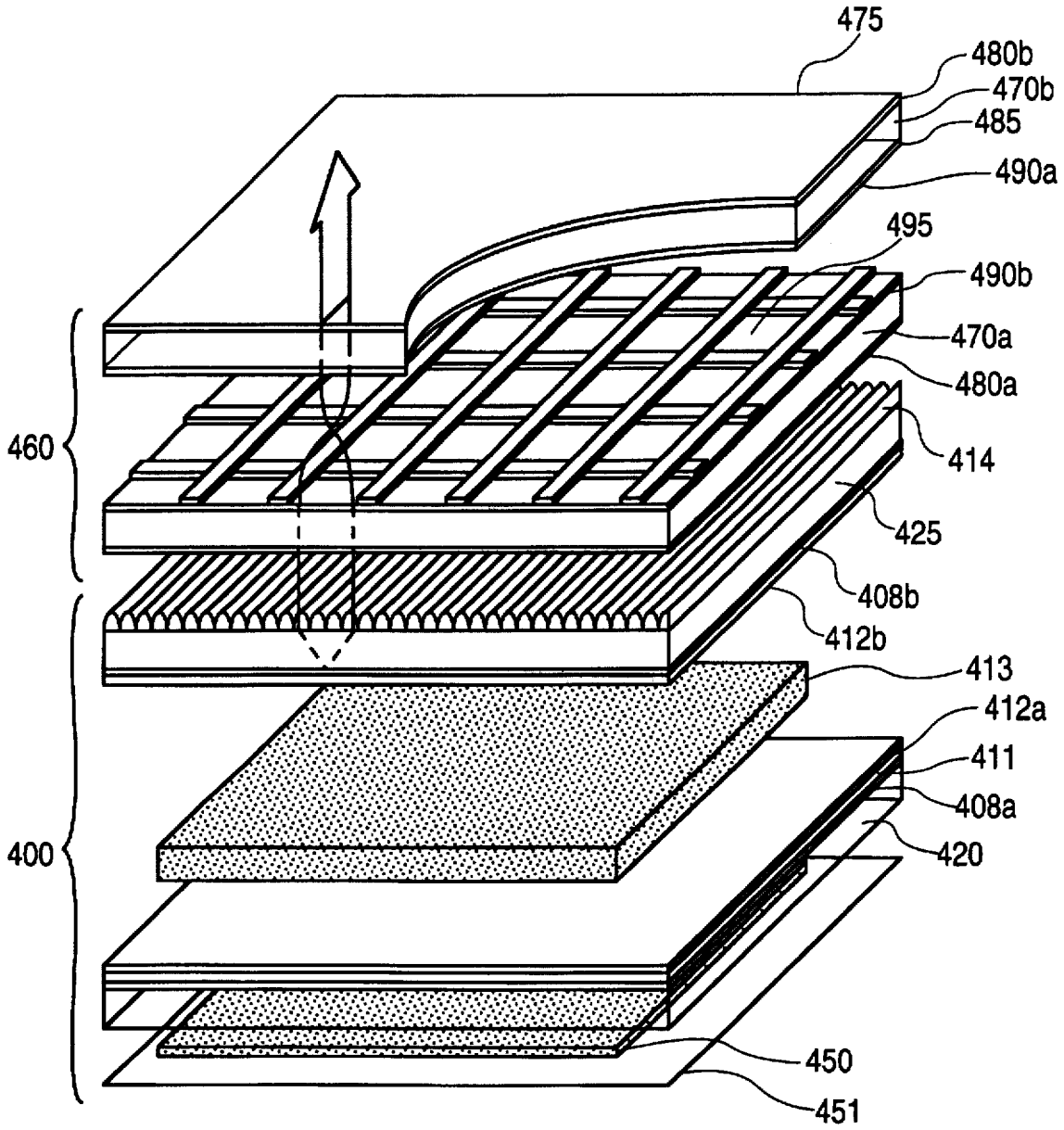
FIG. 4B is an exploded view showing the structural layers in the flat panel display of FIG. 4A.
Figure 4C:
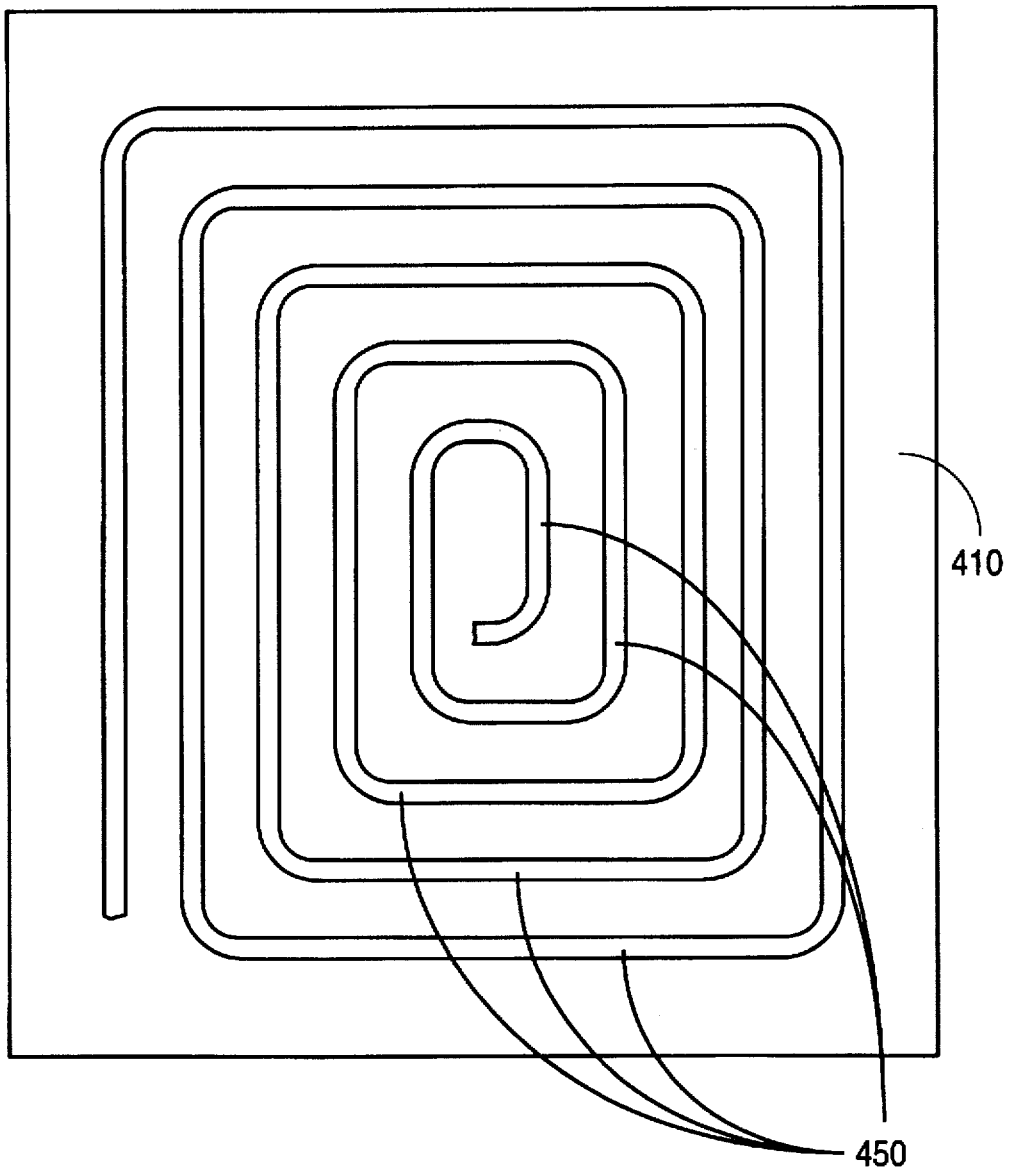
FIG. 4C is a plan view of a quadrilateral spiral excitation coil for the discharge vessel of FIG. 4A.

Referring back to lamp 400 of FIGS. 4A and 4B, RF energy is supplied to excitation coil 450, which is in close proximity to gaseous mixture 413 disposed between front wall 425 and back wall 420. Upon ionization of gaseous mixture 413, a current is induced inside discharge vessel 410 along the overall contours of excitation coil 450. The current in coil 450 generates a potential drop along the path of the current flow, providing the acceleration potential for the plasma electrons of mixture 413, thereby sustaining the discharge.

In this embodiment, excitation coil 450 is positioned in close proximity to plasma mixture 413, to produce an electric field for ignition and a magnetic field for sustaining the H-mode, respectively. Preferably, coil 450 is driven by a Class D or Class E type amplifier. In this manner efficiencies as high as 88% can be achieved.

The minimum spacing between front wall 425 and back wall 420 is approximately 0.6 inches to ensure reasonable efficiency and good integrating characteristics. As a result, the minimum external thickness of discharge vessel 410 is about 0.75 inches. The width and height of backlight lamp 400 is limited by the resolution and driving capability of LCD assembly 460. For example, a 4"× 4" backlight having a single excitation coil has been successfully fabricated. For larger backlights, multiple excitation coils may be combined with glass partitioning of discharge vessel 410 thereby maintaining high efficiency with light uniformity.

One advantage of electrodeless discharge backlight lamp 400 is the absence of electrodes inside discharge vessel 410. As a result, there is no deposit from the inevitable long term sputtering of the electrode materials in an electrode based lamp. This absence of an electrode or filament inside discharge vessel 410 also makes lamp 400 sturdy and highly resistant to shock and vibration. Further, with an all glass discharge vessel 410 lamp, the operating temperature range of backlight lamp 400 is very wide. The operating temperature range of the resulting flat panel display system is limited only by the limitations of LCD assembly 460.

Several additional considerations should be taken into account in the design and fabrication of an electrodeless discharge lamp used as a backlight.

1. Uniformity of Light Output

The uniformity of the emitted light across the face of the backlight can be controlled by careful design and placement of the excitation coil. The maximum amount of UV radiation is produced in the regions where the electron temperature (i.e., the average internal energy of the electrons) is on the order of 3.2 eV. By selection of the gas fill pressure, these regions can be tailored to maximize uniformity. The UV radiation is emitted randomly, and due to the conformal phosphor coating on the inside of the glass enclosure, an integration takes place of all the produced visible light. The depth (i.e., the actual minimum dimension) of the plasma, affects the spatial distribution of the electron temperature profiles and the integrating properties of the glass envelope. The dominant UV production region will be around the perimeter of the plasma current.

2. Phosphor Characteristics

By controlling the mixture ratio of the three components of the tristimulus phosphor, taking into consideration the visible spectra of mercury lines, a wide range of color temperatures is achievable. Moreover, since the phosphors respond linearly with the incident UV flux, a constant color temperature is achievable during dimming of the display.

Figure 5:
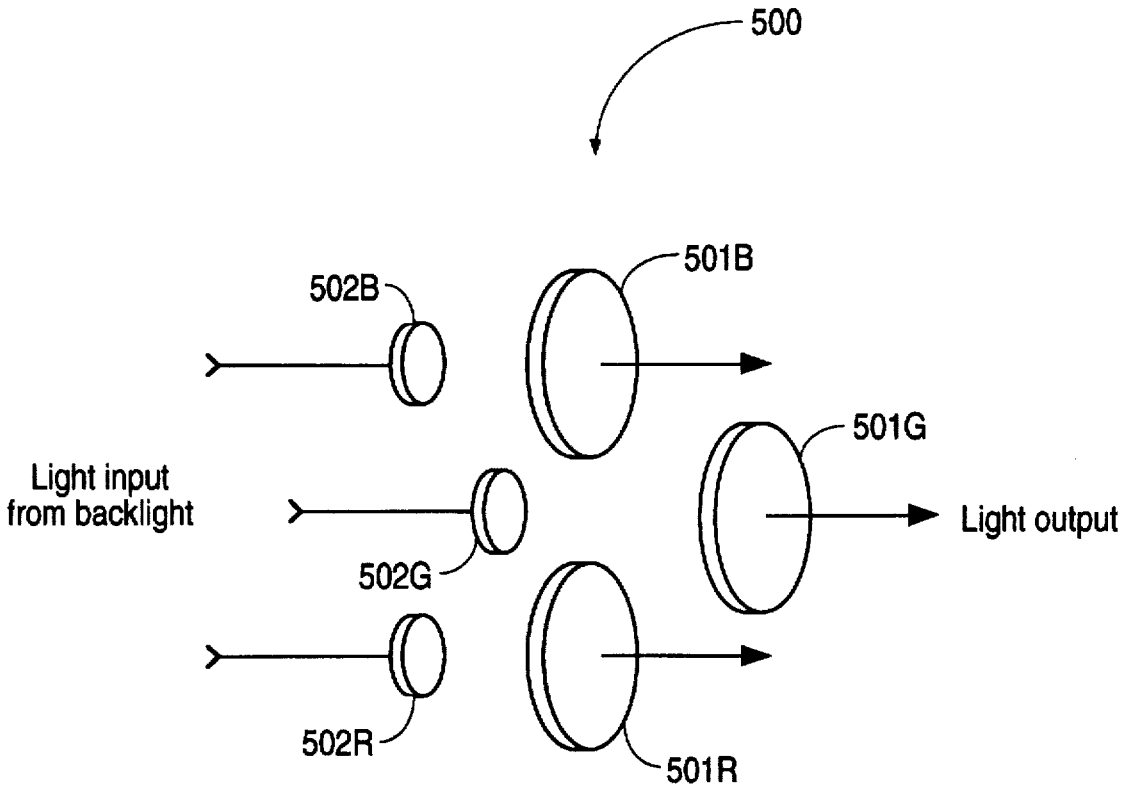
FIG. 5 illustrates schematically the basic structure of a single element in an active matrix display.

These factors make it possible to increase the brightness and color definition of the display. Each element of an active matrix display normally contains three individual pixels, each of which contains a color filter, typically a gel filter. The three color filters in the element are typically red, green and blue (RGB). A light valve (e.g., an LCD switch) is associated with each of the filters to control the amount of light passing through it. This structure is illustrated schematically in FIG. 5, where element 500 of an active matrix display contains light filters 501R, 501G and 501B positioned in front of light valves 502R, 502G and 502B, respectively.

Since the light emitted by conventional electroluminescent backlights is typically deficient in blue content, the transmissivity of the red and green filters is made somewhat lower in order to compensate for the lack of blue light and thereby produce a white light when all of the light valves are fully opened. Reducing the transmissivity of the red and green filters, however, reduces the overall efficiency of the active matrix display. Using an electrodeless discharge lamp as a backlight, in accordance with this invention, permits one to adjust the spectrum of radiation emitted by the backlight and thereby avoid the necessity of intentionally lowering the transmissivity of the filters.

Accordingly, the phosphor mixture ratio can be proportioned to compensate for the difference in the transmission efficiencies of the RGB filters, with special consideration being given to the visible (blue) components of the mercury discharge. The efficiency of a color matrix display using an ordinary electro-luminescent backlight is on the order of 2%. Using the principles of this invention, it is believed that the efficiency can be increased to 4–5%.

3. Longevity of Phosphors

To increase the longevity of the phosphor layer, the use of an electrostatic screen or an RF-driven shield to eliminate electric field components in the glass envelope may be considered. The electric field is unnecessary during the steady state operation of the lamp and may cause sputtering of the phosphor coating. However, the electric field is necessary for ignition. To allow proper ignition, additional circuitry may be used, or the electric field may be allowed to penetrate the electrostatic or RF-driven shield in a defined area. In less demanding applications, the excitation coil and driving electronics can be optimized for minimum electric field generation while the lamp is in the H-mode, by reducing the number of turns and optimizing the pitch of the coil.

4. RF-Driver Requirements

The RF-driver requires a high efficiency which can be obtained with a Class D or Class E type amplifier, as taught in application Ser. No. 07/887,168, filed May 20, 1992, now U.S. Pat. No. 5,306,986, and application Ser. No. 07/894,020, filed Jun. 5, 1992, now U.S. Pat. No. 5,387,050, both of which are incorporated herein by reference. The amplifier needs to be capable of driving a high Q circuit (E-mode), where there is no appreciable loading of the excitation coil, and a low Q circuit (H-mode), where the induced plasma current presents a load to the excitation coil. These requirements can be met by the use of an impedance matching and filter network such as is described in application Ser. No. 08/064,779, filed May 19, 1993, incorporated herein by reference.

5. Dimming Capabilities

Dimming of the display can be achieved with two basic concepts: (i) The oscillator that drives the amplifier can be pulse width modulated. The modulation circuitry should be adapted such that the longest "off" time is shorter than the electron recombination time. (ii) The second method deploys amplitude modulation of the amplifier output square wave. In this case, the minimum amplitude is determined by the minimum number of ampere turns required to sustain the H-mode. By combining both concepts (i) and (ii), a dimmable range of better than 2,000:1 should be achievable.

In sum, advantages of using an electrodeless discharge lamp 400 as a backlight include increased brightness, improved uniformity and a wide dimmability range (2000:1). In addition, lamp 400 provides the flat panel display with a rigid backlight that has a long life expectancy and is also energy efficient.

While several embodiments have been described, these descriptions are not intended to be limiting and other embodiments will be obvious to those skilled in the art based on this disclosure. Thus, while this invention has been described using vessel shapes, coil forms and collimating structures for electrodeless discharge lamps, the principles of this invention apply equally well to preferential direction for any light source.

I claim:

1. A discharge vessel for containing an ionizable gaseous mixture in an electrodeless discharge lamp, said discharge vessel comprising:

a substantially flat planar front wall having an inner and an outer surface;

a substantially flat planar back wall having an inner surface, said back wall substantially parallel to the front wall;

a side wall joining said front wall and said back wall; and a phosphor layer disposed over the inner surface of said back wall and the inner surface of said front wall for converting ultraviolet light emitted by the gaseous mixture into visible light.

2. The discharge vessel of claim 1 further comprising a reflective layer disposed between the inner surface of said back wall and said phosphor layer, said reflective layer for reflecting visible light emitted by said phosphor layer back into an enclosed space between said front and back walls.

3. The discharge vessel of claim 2 wherein said front and back walls are circular in shape.

4. The discharge vessel of claim 2 wherein said front and back walls are rectangular in shape.

5. The discharge vessel of claim 2 wherein at least one of said front and back walls is slightly convex with respect to said gaseous mixture.

6. The discharge vessel of claim 2 wherein at least one of said front and back walls is slightly concave with respect to said gaseous mixture.

7. The discharge vessel of claim 2 wherein said reflective layer extends onto an inner surface of a side wall, said side wall being joined to said front wall and said back wall.

8. The discharge vessel of claim 2 wherein the front wall comprises an integrated collimating structure for focusing the visible light in a preferential direction.

9. The discharge vessel of claim 2 further comprising a collimating structure disposed on the outer surface of said front wall for focusing the visible light in a preferential direction.

10. The discharge vessel of claim 9 wherein said collimating structure is a fresnel lens.

11. The discharge vessel of claim 9 wherein said collimating structure comprises a plurality of concentric ridges.

12. An electrodeless discharge lamp comprising:

a discharge vessel having a substantially flat planar front wall with an inner and an outer surface, and a substantially flat planar back wall having an inner and an outer surface, and wherein said back wall is substantially parallel to said front wall, and said vessel contains an ionizable gaseous mixture;

a side wall joining said front wall and said back wall;

excitation means disposed adjacent to the outer surface of said back wall, said excitation means for exciting said gaseous mixture; and a phosphor layer disposed over the inner surface of said back wall and the inner surface of said front wall for converting ultraviolet light emitted by the gaseous mixture into visible light.

13. The electrodeless lamp of claim 12 further comprising a reflective layer disposed between the inner surface of said back wall and said phosphor layer, said reflective layer for reflecting visible light emitted by said phosphor layer back into an enclosed space disposed between said front and back walls.

14. The electrodeless lamp of claim 13 wherein said front and back walls are circular in shape, and said excitation means is substantially planar and comprises a spiral coil.

15. The electrodeless lamp of claim 13 wherein said front and back walls are substantially rectangular in shape, and said excitation means is substantially planar and comprises a quadrilateral spiral coil.

16. The electrodeless lamp of claim 13 wherein at least one of said front and back walls is slightly concave with respect to said gaseous mixture.

17. The electrodeless lamp of claim 13 wherein at least one of said front and back walls is slightly convex with respect to said gaseous mixture.

18. The electrodeless lamp of claim 13 wherein said reflective layer extends onto an inner surface of a side wall, said side wall being joined to said front wall and said back wall.

19. The electrodeless lamp of claim 13 wherein the front wall comprises an integrated collimating structure for focusing the visible light in a preferential direction.

20. The electrodeless lamp of claim 13 wherein said excitation means comprises a plurality of coils.

21. The electrodeless lamp of claim 13 further comprising a collimating structure disposed on the outer surface of the front wall for focusing the visible light in a preferential direction.

22. The electrodeless lamp of claim 21 wherein said collimating structure is a fresnel lens.

23. The electrodeless lamp of claim 21 wherein said collimating structure comprises a plurality of concentric ridges.

24. A discharge vessel for containing an ionizable gaseous mixture in an electrodeless discharge lamp, said discharge vessel comprising:

a cup-shaped front wall having an inner and an outer surface;

a cup-shaped back wall having an inner surface said cup-shaped back wall having substantially the same shape as said cup-shaped front wall;

a phosphor layer disposed over the inner surface of said back wall and the inner surface of said front wall for converting ultraviolet light emitted by the gaseous mixture into visible light a reflective layer disposed between the inner surface of said back wall and said phosphor layer, said reflective layer for reflecting visible light emitted by said phosphor layer back into an enclosed space disposed between said front and back walls; and a collimating structure disposed on an outer surface of the front wall for focusing the visible light in a preferential direction.

25. The discharge vessel of claim 24 wherein the front wall comprises an integrated collimating structure for focusing the visible light in a preferential direction.

26. The discharge vessel of claim 24 wherein said collimating structure is a fresnel lens.

27. The discharge vessel of claim 24 wherein said collimating structure comprises a plurality of concentric ridges.

28. An electrodeless discharge lamp comprising:

a discharge vessel having a cup-shaped from wall with an inner and an outer surface, and a cup-shaped back wall having an inner and an outer surface, said cup-shaped back wall having substantially the same shape as said cup-shaped front wall, and wherein said vessel contains an ionizable gaseous mixture;

excitation means disposed adjacent to the outer surface of the back wall, said excitation means for exciting said gaseous mixture;

a phosphor layer disposed over the inner surface of said back wall and the inner surface of said front wall for converting ultraviolet light emitted by the gaseous mixture into visible light; and a reflective layer disposed between the inner surface of said back wall and said phosphor layer, said reflective layer for reflecting visible light emitted by said phosphor layer back into an enclosed space disposed between said front and back walls.

29. The electrodeless lamp of claim 28 wherein said excitation means is a conical spiral coil.

30. The electrodeless lamp of claim 28 wherein said reflective layer extends onto an inner surface of a side wall, said side wall being joined to said front wall and said back wall.

31. The discharge vessel of claim 28 wherein the front wall comprises an integrated collimating structure for focusing the visible light in a preferential direction.

32. The discharge vessel of claim 28 wherein said front wall and said back wall are concave towards a front of said lamp.

33. The discharge vessel of claim 28 wherein said front wall and said back wall are convex towards a front of said lamp.

34. The discharge vessel of claim 28 further comprising a collimating structure disposed on the outer surface of the front wall for focusing the visible light in a preferential direction.

35. The discharge vessel of claim 34 wherein said collimating structure is a fresnel lens.

36. The discharge vessel of claim 34 wherein said collimating structure comprises a plurality of concentric ridges.

* * * * *